US008845053B2

(12) United States Patent
Hirosawa et al.

(10) Patent No.: US 8,845,053 B2
(45) Date of Patent: Sep. 30, 2014

(54) INKJET PRINTING DEVICE AND INKJET PRINTING METHOD

(75) Inventors: Susumu Hirosawa, Tokyo (JP); Yutaka Kano, Yokohama (JP); Kentarou Muro, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 129 days.

(21) Appl. No.: 13/368,486

(22) Filed: Feb. 8, 2012

(65) Prior Publication Data

US 2012/0206523 A1 Aug. 16, 2012

(30) Foreign Application Priority Data

Feb. 14, 2011 (JP) ..... 2011-028917

(51) Int. Cl.
*B41J 29/38* (2006.01)
*B41J 2/165* (2006.01)

(52) U.S. Cl.
CPC ..... *B41J 29/38* (2013.01); *B41J 2/16547* (2013.01); *B41J 2/16526* (2013.01); *B41J 2/16585* (2013.01)
USPC ..... 347/12

(58) Field of Classification Search
CPC ..... B41J 2/1652; B41J 2/155; B41J 1/145; B41J 2/2135
USPC ..... 347/9–12, 40–43
See application file for complete search history.

(56) References Cited

U.S. PATENT DOCUMENTS

| | | | | |
|---|---|---|---|---|
| 7,578,574 | B2 * | 8/2009 | Suzuki | 347/35 |
| 7,963,622 | B2 * | 6/2011 | Ishida | 347/12 |
| 8,480,195 | B2 * | 7/2013 | Fujisawa et al. | 347/9 |
| 2008/0055357 | A1 | 3/2008 | Hamasaki et al. | |

FOREIGN PATENT DOCUMENTS

JP 2006-076247 A 3/2006

OTHER PUBLICATIONS

U.S. Appl. No. 13/365,366, filed Feb. 3, 2012.

* cited by examiner

*Primary Examiner* — An Do
(74) *Attorney, Agent, or Firm* — Fitzpatrick, Cella, Harper & Scinto

(57) ABSTRACT

In-image preliminary ejection is performed by use of nozzles used to print an image out of the nozzles included in an overlapping link region, and between-image preliminary ejection is performed by use of nozzles which are not used to print the image. Thus, a reduction in image quality is inhibited, while the amount of print media used in the between-image preliminary ejection is reduced.

17 Claims, 9 Drawing Sheets

INKJET PRINTING DEVICE AND INKJET PRINTING METHOD

BACKGROUND OF THE INVENTION

1. Field of the Invention

This invention relates to an inkjet printing device and an inkjet printing method which enable ejection recovery of a print head while reducing the ink consumption and the amount of paper waste.

2. Description of the Related Art

In inkjet printing techniques, the ejection recovery operation is known for solution of disadvantageous problems of deterioration in printing quality and the like which result from an ejection failure caused by clogging in a nozzle in a print head or the like or from an increase in ink concentration caused by evaporation of water from a nozzle. In the ejection recovery operation, ink is ejected from the print head for removing the ink of increased viscosity from within the nozzle. There are two techniques for this purpose, the technique of ejecting ink to an area other than a print medium, for example, to the inside of the cap or the like, and the technique of ejecting ink on a print medium (on-paper preliminary ejection), for example, when a plurality of images are continuously printed. In turn, the on-paper preliminary ejection includes a technique of ejecting ink between a plurality of print images to be printed on the print medium (between-image preliminary ejection), and a technique of ejecting ink within a print image to be printed (in-image preliminary ejection). Japanese Patent Laid-Open No. 2006-076247 describes the technique of monitoring at all times or counting the presence/absence of ink ejection from each nozzle within a certain time period to determine the necessity of the in-image preliminary ejection for each of the target nozzles and performing both the between-image preliminary ejection and the in-image preliminary ejection for the purpose of providing desired printing quality.

SUMMARY OF THE INVENTION

However, particularly in a print head with a large number of nozzles, the technique of monitoring at all times or counting the presence/absence of ink ejection from each nozzle within a certain time period to determine the necessity of the in-image preliminary ejection requires an increase in size of an electric (hardware) structural element of the main body, resulting in increased cost. It is also contemplated to employ a method of performing both the between-image preliminary ejection and the in-image preliminary ejection in use of all the nozzles at all times. In this case, the amount of ink used in the preliminary ejection and the amount of print media used in the between-image preliminary ejection and eventually resulting in paper wastes are inevitably increased. The present invention is made to solve the above disadvantages and it is an object of the present invention to provide techniques for removing the ink of increased viscosity or the like from within the nozzle while adopting a simpler and inexpensive structure and additionally for reducing the amount of ink used and the amount of paper waste produced in preliminary ejection.

To solve the disadvantages, the present invention provides an inkjet printing device using a print head which includes a first nozzle row in which a plurality of nozzles are arranged along a predetermined direction, and a second nozzle row in which a plurality of nozzles are arranged along the predetermined direction, the first nozzle row and the second nozzle row being displaced with respect to each other in a conveyance direction perpendicular to the predetermined direction and a part of the first nozzle row and a part of the second nozzle row overlapping each other in the predetermined direction to form a link region. The inkjet printing device comprises preliminary ejection means that performs preliminary ejection of ink from each of the plurality of nozzles onto the print medium. The preliminary ejection means is capable of performing in-image preliminary ejection into the inside of the image and between-image preliminary ejection into a region between a plurality of the images. The preliminary ejection means uses a part of the nozzles included in the link region to perform the in-image preliminary ejection, and uses the nozzle not used to perform the in-image preliminary ejection out of the nozzles included in the link region to perform the between-image preliminary ejection.

To solve the disadvantages, the present invention provides an inkjet printing method which is used by an inkjet printing device using a print head which includes a first nozzle row in which a plurality of nozzles are arranged along a predetermined direction, and a second nozzle row in which a plurality of nozzles are arranged along the predetermined direction, the first nozzle row and the second nozzle row being displaced with respect to each other in a conveyance direction perpendicular to the predetermined direction and a part of the first nozzle row and a part of the second nozzle row overlapping each other in the predetermined direction to form a link region. The inkjet printing method comprises a preliminary ejection process of performing preliminary ejection of ink from each of the plurality of nozzles on the print medium. The preliminary ejection process is capable of performing in-image preliminary ejection into the inside of the image and between-image preliminary ejection into a region between a plurality of the images. The preliminary ejection process uses a part of the nozzles included in the link region to perform the in-image preliminary ejection, and uses the nozzle not used to perform the in-image preliminary ejection out of the nozzles included in the link region to perform the between-image preliminary ejection.

The inkjet printing device according to the present invention controls the between-image preliminary ejection in accordance with an arrangement state of a plurality of chips or nozzles in the print head. According to the present invention, without a complicated and costly structure, it is possible to perform the ejection recovery operation solving the disadvantages such as deterioration in printing quality and the like which result from an ejection failure caused by nozzle clogging or the like or from an increase in ink concentration caused by evaporation of water from a nozzle, with a minimum ink consumption and a minimal amount of paper waste.

Further features of the present invention will become apparent from the following description of exemplary embodiments (with reference to the attached drawings).

DESCRIPTION OF THE EMBODIMENTS

Figure 1:
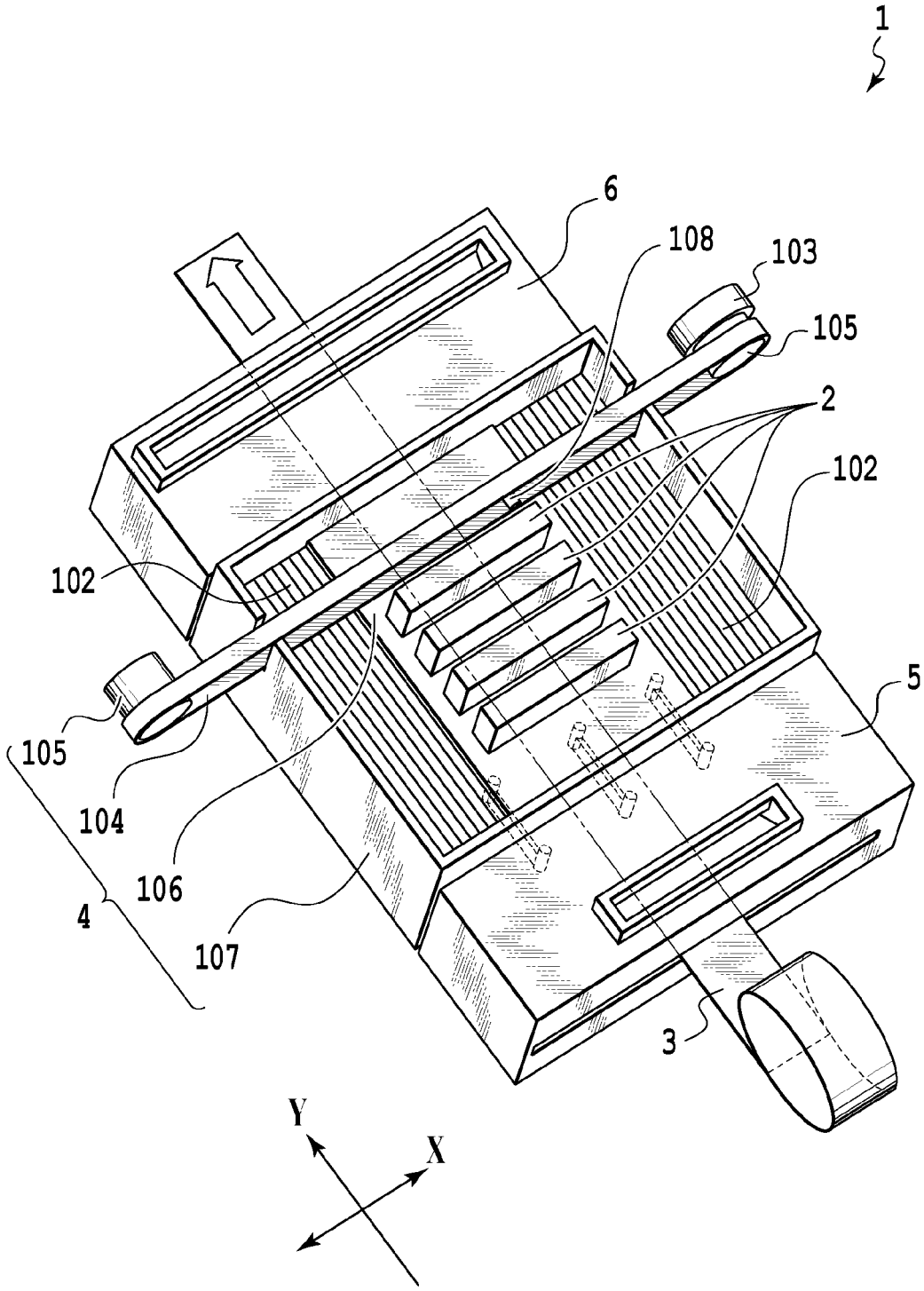
FIG. 1 is a schematically perspective view of a principal structural part of an inkjet printing device.

Preferred embodiments according to the present invention will be described below in detail with reference to the accompanying drawings. In the following, the embodiments are described by taking a printing device using a print head according to the inkjet printing method, namely, an inkjet printing device, as an example.

In the specification, the term "recording/record" (referred to also as "printing/print" in some cases) represents not only a process of forming intentional information such as letters, figures (graphic form) and the like, but also a process of widely forming an image, design, pattern and the like on a print medium or of processing a medium. That is, a subject to be recorded/printed may be an intentional subject, an unintentional subject, or any subject irrespective of whether or not the subject becomes obvious such that a human can visually perceive it.

In the specification, the term "print medium" represents not only paper used in general printing devices, but also an ink-acceptable medium such as widely made of cloth, plastic film, metallic plate, glass, ceramics, wood, leather or the like.

In the specification, the term "ink" (referred to also as "liquid") should be widely interpreted in common with the definition of the above "recording/record". Specifically, the term "ink" represents liquid available for formation of an image, design, pattern or the like or processing of a print medium by being applied on the print medium, or for treatment to ink (for example, coagulation or insolubilization of coloring materials in ink applied on the print medium).

In the specification, the term "nozzle" means, unless otherwise specified, a summation of an ejection opening, a flow path communicating with the ejection opening, and a device generating energy used for ink ejection.

In the specification, the term "printed image" represents an image recorded/printed on the print medium. As seen from the above definition of the term "recording/record", printed records may include "design", "pattern" and the like as well as "image", and they are collectively called "image" for the sake of convenience. The printed images include an image printed for the purpose of recording, and an image formed as a result of applying ink droplets by the preliminary ejection defined as follows.

In the specification, the term "preliminary ejection" represents ejection of ink from the print head for removing a higher viscosity ink or the like from a nozzle which is performed as an operation of nozzle ejection recovery. The preliminary ejection includes the technique of ejecting ink on a print medium (on-paper preliminary ejection (first preliminary ejection)) and the technique of ejecting ink on an area other than the print medium, for example, into the inside of the cap or the like (second preliminary ejection).

In the specification, the term "between-image preliminary ejection" represents on-paper preliminary ejection which is performed to a white space of the print medium between a plurality of images to be printed thereon for the purpose of recording when a plurality of images are continuously printed.

In the specification, the term "in-image preliminary ejection" represents on-paper preliminary ejection which is performed to the inside of an image to be printed for the purpose of recording.

First Embodiment

A method of ejection recovery for a print head in an inkjet printing device according to a first embodiment of the present invention is described, in which the on-paper preliminary ejection is performed with the number of times ink is ejected in the between-image preliminary ejection being varied from one nozzle group to another depending on an array state of a plurality of chips or nozzles in the print head.

FIG. 1 is a schematically perspective view of a principal structural part of the inkjet printing device according to the first embodiment of the present invention.

The inkjet printing device 1 comprises a most-upstream feeder in which a print medium 3 in a roll form is loaded, a printing unit 4 performing a printing operation, and a feeder advance mechanism (not shown) that conveys the print medium 3 to a position within the printing unit 4 facing print heads 2 and then conveys the print medium 3 at a predetermined speed during the printing operation. The inkjet printing device 1 operates the printing unit 4 provided in an approximately enclosed space defined by a housing frame 107 to eject ink on the print medium 3 from the print head 2 to print an image on the print medium 3. An air-flow supply unit 5 and an air-flow collecting unit 6, which are arranged adjacent to the printing unit 4, produce a humidified air flow traveling near the nozzle surface of the print head 2, and then use the humidified air flow to collect ink mist generated during the printing operation. After the printing operation at the printing unit 4, the printed print medium 3 is conveyed to a cutter unit (not shown) to be cut to a predetermined length, and then conveyed to a drying unit (not shown) to dry the ink on the print medium 3. Then, the print medium 3 is discharged from the drying unit and then stacked on a discharge unit (not shown).

The print heads 2 are described as four print heads corresponding to the four CMYK colors in the example, but may be designed as a plurality of print heads respectively corresponding to different ink colors or a print head corresponding to a color. The number of colors is not limited to four. Ink of each color is delivered from the corresponding ink tank (not shown) through the corresponding ink tube (not shown) to the corresponding print head 2.

A plurality of print heads 2 are held as one piece in a holder 106. The holder 106 has a mechanism capable of vertically moving so as to change the distance between the print heads 2 and the surface of the print medium 3. Specifically, the holder 106 can be moved by the drive mechanism in a direction perpendicular to the print surface of the print medium 3 to a printing operation position, a predetermined position to perform the preliminary ejection on an area other than the print medium, a predetermined position to wipe the nozzle surface, a predetermined position to perform capping to inhibit drying of the nozzle surface under non-printing conditions, and the like. The print head 2 moved to the predetermined position to perform the preliminary ejection on an area other than the print medium (preliminary ejection position) can preliminarily eject ink toward a cap unit (not shown) comprising a cap moved under the print heads 2 for the preliminary ejection onto the area other than the print medium.

The holder 106 is capable of moving to a relative position in the direction X approximately perpendicular to the convey direction Y conveying the print medium in order to level imbalances in the number of times ink is ejected between the used nozzle and the non-used nozzle caused by a difference between the printable width of the print head 2 and the maximum width of the print medium 3. To this movement, the holder 106 is secured to a belt 104 at an attaching member 108, and a pulley 105 mounted to the belt 104 is driven by a pulse motor 103. The pulse motor 103 is pulse-controlled to move the holder 106 for averaging of the numbers of ejections from a plurality of nozzles arranged in the print head 2 on the basis of data from an external information terminal (not shown). The data includes information on a size (paper width) of the print medium and a cumulative number of ejections from the nozzles of the print head 2. The holder 106 after moving is fixed to a suitable position by a fixing mechanism (not shown). Accordingly, it is possible to convey the print medium 3 to be printed by the print head 2 without regard for the width of the print head inside the inkjet printing device. In the example, the width of the print head is 12 inch, and if printing may be done with this width of the print head, the structure can convey a plurality of types of print media 3 of different widths.

The inkjet printing device 1 further includes a control unit (not shown) which controls the print head 2, the feeder advance mechanism, the discharge mechanism, and other mechanisms. The inkjet printing device 1 also includes a power-source unit (not shown) which supplies electric energy to parts of a driving unit (not shown), the print head 2, a heater board and the like which are located in the device.

Figure 2:
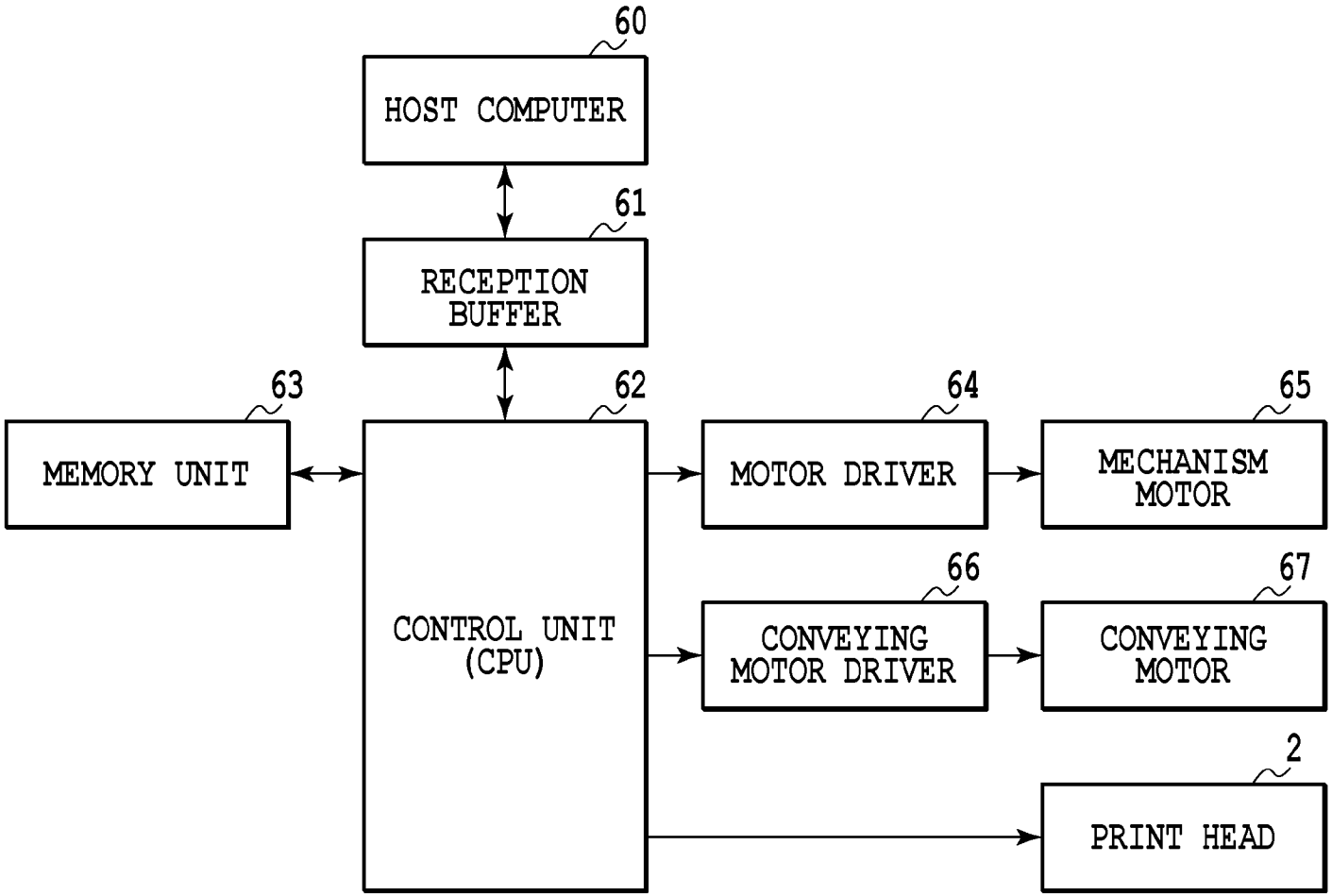
FIG. 2 is a block diagram of a control system of the inkjet printing device.

FIG. 2 shows a block diagram of a control system used in the above-described inkjet printing device. A reception buffer 61 of the inkjet printing device receives data on letters and images to be printed from a host computer 60. Then, the inkjet printing device sends to the host computer 60 data for confirming whether or not the data is correctly transferred and the like, and data indicative of an operation state of the inkjet printing device. The data in the reception buffer 61 is transferred to a memory 63 and temporarily stored in a RAM (Random Access Memory) under control of a control unit (CPU, Central Processing Unit) 62.

Based on instructions from the CPU 62, a motor driver 64 operates a motor 65 of the mechanisms such as the cap, the wiper and the like. Based on instructions from the CPU 62, a conveying motor driver 66 controls a conveying roller which is the feeder advance mechanism of conveying the print medium 3. The CPU 62 provides instructions to control the operation of the print head 2 for printing of an image and the preliminary ejection. Inside the print head 2, a heater board (element substrate) which is a silicon substrate on which a heating resistance element for ejecting ink droplets, an electric circuit for controlling the heating resistance element, and a driver element are integrated is placed. A print-head temperature detection sensor is placed on the heater board to detect a temperature of the print head 2. As this detection sensor, a sensor using temperature characteristics of the output voltage of a diode, a sensor using temperature characteristics of the resistance value of an electric resistor, or the like may be used.

Next, a brief description will be given of an ejection recovery method for the print head in the inkjet printing device according to the present embodiment.

Figure 3:
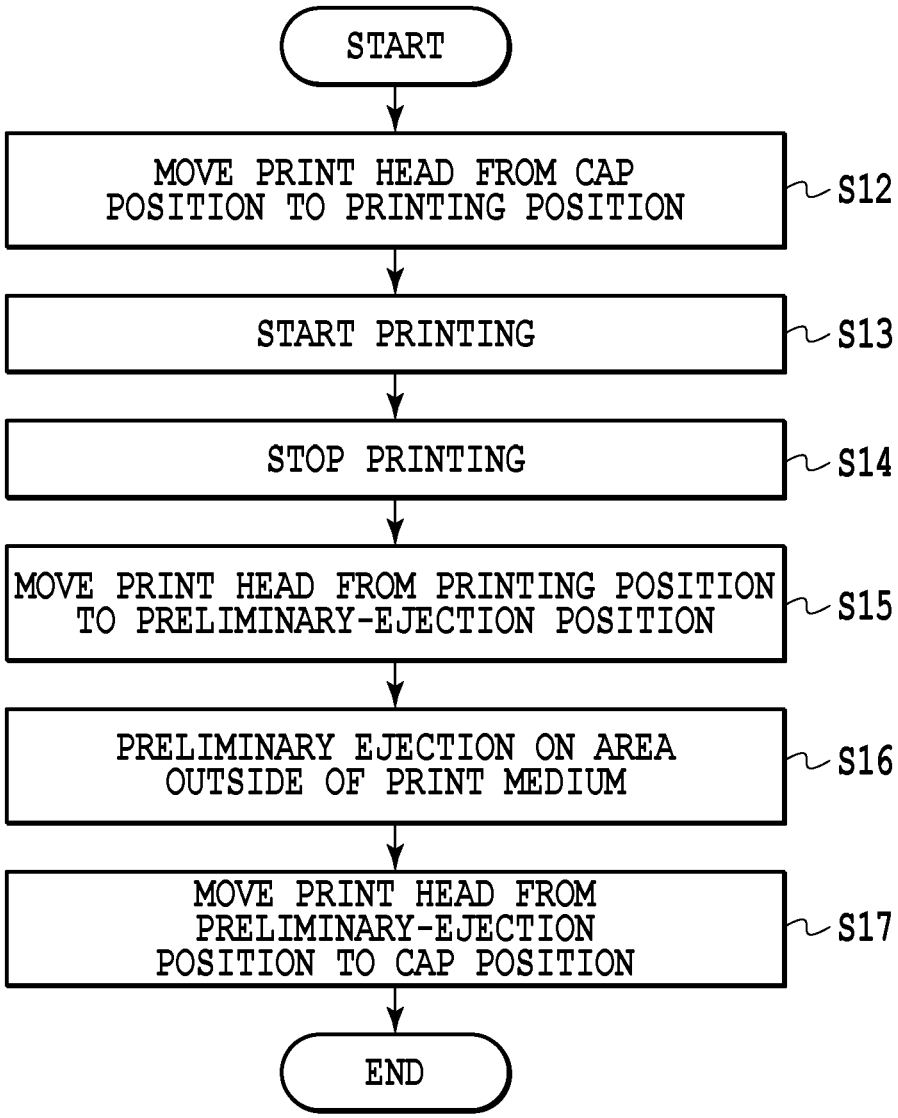
FIG. 3 is a flowchart illustrating an ejection recovery method in the printing operation according to an embodiment of the present invention.

The inkjet printing device and the inkjet printing method according to the present embodiment has the feature that is a method for on-paper preliminary ejection from the print head. FIG. 3 is a flowchart briefly showing the nozzle ejection recovery method for the print head. First, at step S12, for starting the printing operation upon reception of a printing command from an operator, the motor driver 64 operates the mechanism motor 65 to move the print head 2 from the predetermined position for capping (capping position) to the printing operation position (printing position). At step S13, the conveying motor driver 66 controls the conveying roller conveying the print medium 3 to convey the print medium 3, and the instructions from the CPU 62 control the operation of the print head 2 to start the printing of an image. At this stage, the in-image preliminary ejection and the between-image preliminary ejection, which will be described later, are performed.

Figure 4A:
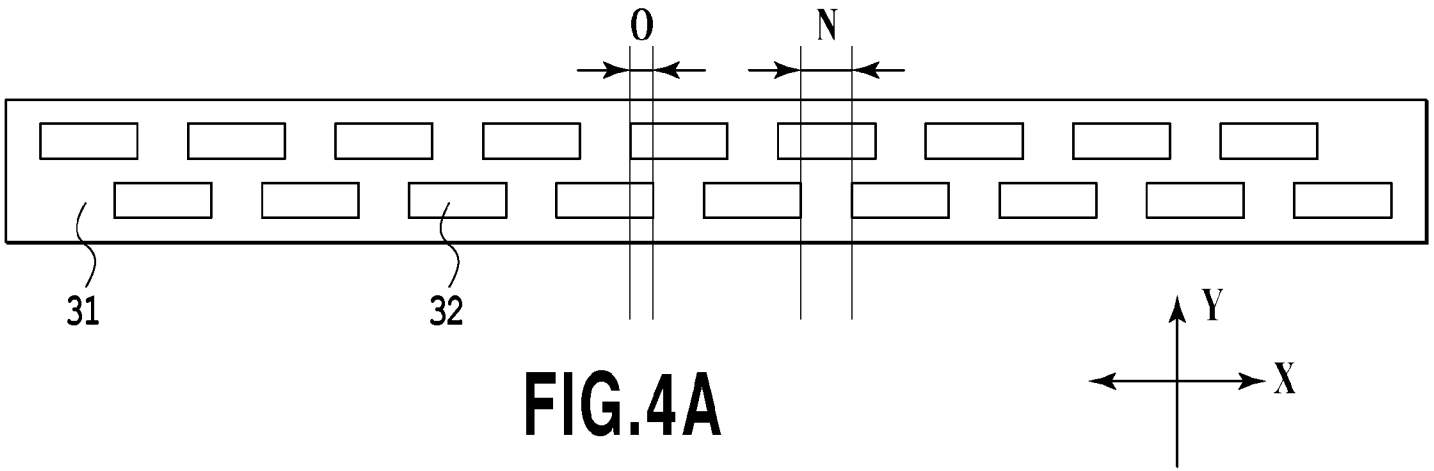
FIG. 4A is a plan view of a print head according to an embodiment of the present invention.
Figure 4B:
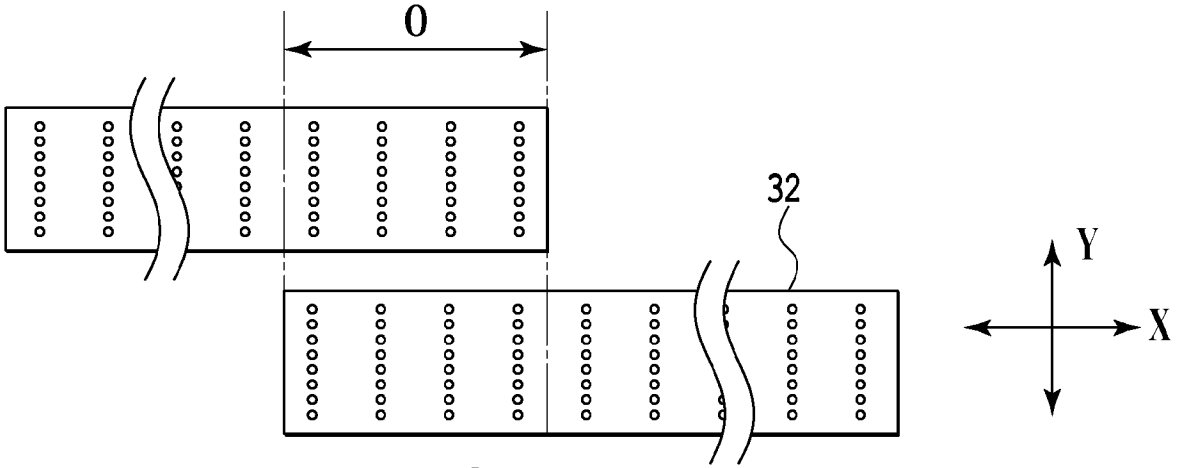
FIG. 4B is a plan view showing nozzles arranged on a chip of the print head.

FIG. 4A is a plan view of a base plate 31 of the print head 2, in which an array of chips 32 mounted is shown in a perspective view. FIG. 4B shows the nozzles arranged in the chip. As shown in FIG. 4B, the print head in the present embodiment is a so-called line head with a continuous array of a plurality of chips. On each chip 32, a plurality of nozzles is arranged in a predetermined direction to form a plurality of nozzle rows. Ink is ejected from the nozzles. In the arrangement of the chips 32 shown in FIG. 4A, when the print head is mounted on the inkjet printing device, the chips 32 are lined up in two rows each extending in the direction X of the width of the print medium. In the conveyance direction Y conveying the print medium crossing the direction X, the chips 32 have regions overlapping each other. This is for the purpose of inhibiting image degradation including streaks or the like caused by a mounting error occurring when the chips are mounted or a landing error occurring when ejected ink lands. The overlapping region is called a "link region O", while the region where the chips 32 do not overlap each other is called a "non-link region N". As shown in FIG. 4B, the non-link region N includes eight nozzle rows arranged in the conveyance direction Y, while the link region O includes 16 nozzle rows twice as much as the non-link region N.

Figure 8:
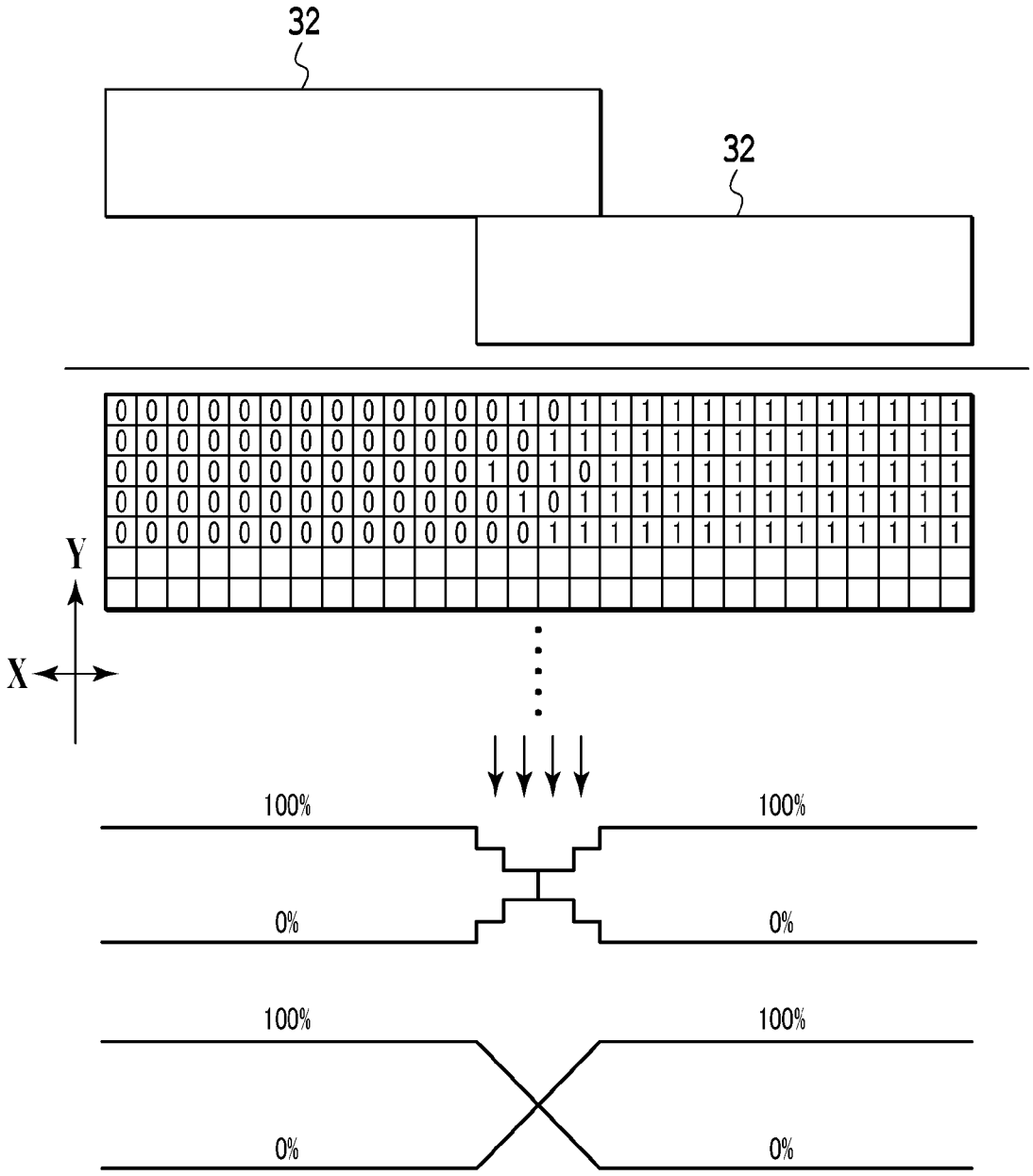
FIG. 8 is a diagram illustrating the distribution ratios of image data distributed to a link region of two overlapping chips.

In this connection, a distribution ratio of image data distributed to the link region of the two overlapping chips will be described with reference to FIG. 8. In the present embodiment, in the printing of an image, not all the 16 nozzle rows located in the link region O are used, but a part of them is used. As shown in FIG. 8, the image data are distributed such that the distribution ratio is reduced gradually from a central portion of each chip toward the ends. At this stage, the data distribution is performed by use of a so-called gradation mask. The amount of image data distributed to the nozzle rows (first nozzle rows) on one of the chips in the direction X in which the nozzles in the nozzle rows are arranged is gradually decreased toward the end, while the amount of image data distributed to the nozzle rows (second nozzle rows) on the other chip is increased gradually from the end toward the central portion. It is assumed in the present embodiment that the total of the image data distributed to the two chips is 100%. However, the image data may be distributed such that the total exceeds 100% or falls below 100% in accordance with the number of nozzle rows, ink characteristics or print-medium characteristics. When an image is printed in this manner, the distribution of the image data as described above allows an image printed near the link region of the chips to be inhibited from image degradation of streaks produced in the image. In the present embodiment, regarding some nozzles, to which the image data are distributed, of all the nozzles of the 8 nozzle rows in the link region O, the same nozzles are used at all times to print a single image. For example, if four of the eight nozzles arranged in the direction Y which is the conveyance direction of the print medium are used in the printing, a combination of the specific four nozzles is used during the printing of the single image. Then, for the next image, a combination of the other four nozzles is used. As a result, the use of the certain nozzles alone can be prevented. On the other hand, if ejection failure occurs in the nozzles used in the link region O, these nozzles can be compensated by corresponding different nozzles in the direction Y to achieve the printing. Such printing is hereinafter referred to as "non-ejection compensation". As described above, all the eight nozzles arranged in the direction Y in the link region O are not used simultaneously to perform printing. However, considering the case of using different nozzles in the non-ejection compensation, there is a necessity to maintain all the nozzles in the condition of being capable of ejecting ink normally.

Accordingly, in the present embodiment, regarding the nozzles located in the link region O, the in-image preliminary ejection is performed by use of only a combination of the nozzles used to print an image, and the between-image preliminary ejection is performed by use of the nozzles of all the eight nozzle rows. Then, regarding the nozzles located in the non-link region N, they are used only to perform the in-image preliminary ejection, and not used to perform the between-image preliminary ejection. As a result, the amount of ink preliminarily ejected into the inside of an image is minimized to reduce the ink density by the preliminary ejection, thus inhibiting image degradation. In addition, ink can be ejected normally from the nozzles used to print an image. The nozzles, which are not used to print an image, out of all the nozzles located in the link region O can be maintained in the condition of being capable of ejecting ink normally.

Next, the advantageous effects produced by the aforementioned structure according to the present embodiment will be described in detail. By performing the in-image preliminary ejection into the inside of an image to be printed for the purpose of recording, the proportion of the between-image preliminary ejection can be reduced as much as possible to minimize the amount of paper waste. However, the brightness of the printed image is reduced by performing the in-image preliminary ejection. In general, if the density of the ink droplets applied to the print medium by the in-image preliminary ejection is somewhat lower, an image of the higher brightness is provided in the end. On the contrary, if the density of the ink droplets applied to the print medium by the in-image preliminary ejection is somewhat higher, the image provided finally has an extremely low brightness, giving rise to so-called "coloring" phenomenon. For suppressing this phenomenon, it is advantageous to perform the in-image preliminary ejection such that ink is ejected onto a region of the print image on the print medium at intervals longer than a certain distance. In the preliminary ejection on the print medium (on-paper preliminary ejection), an increase in proportion of the in-image preliminary ejection is effective for a reduction in the amount of paper waste which is an object of the present invention, but in terms of the coloring, there is a limit to the on-paper preliminary ejection using the in-image preliminary ejection alone.

Figure 5A:
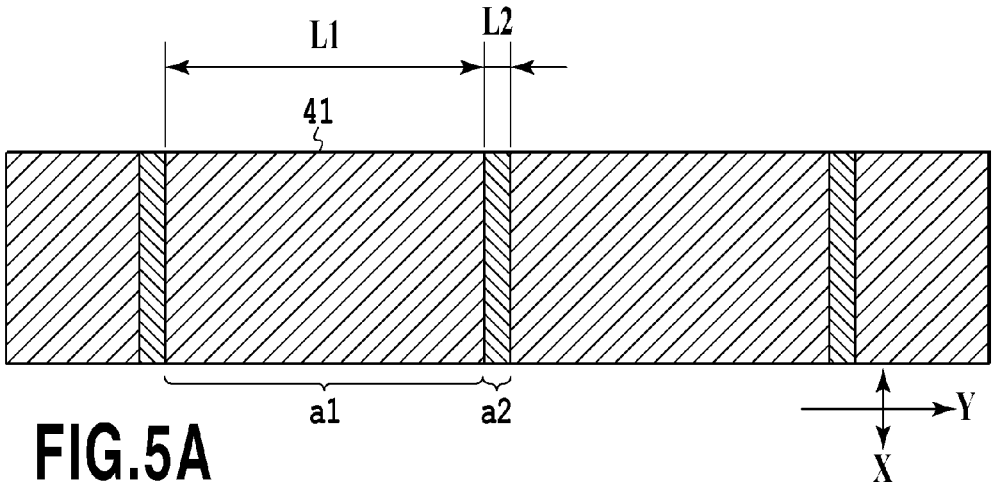
FIG. 5A and FIG. 5B show the layout of the pattern of ink droplets applied on a print medium by the on-paper preliminary ejection according to an embodiment of the present invention.
Figure 5B:
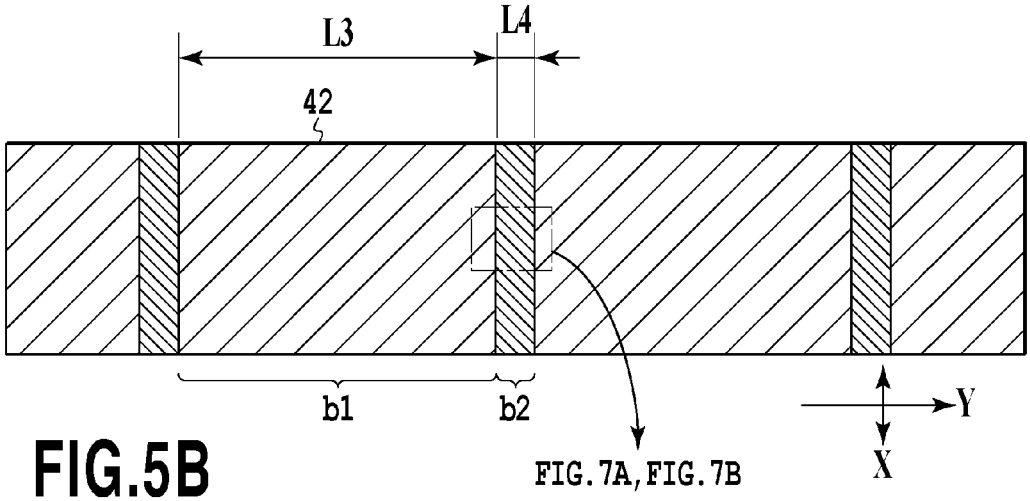

This state will be described with reference to FIG. 5A and FIG. 5B illustrating the placement of ink droplets applied on the print medium by the preliminary ejection (on-paper preliminary ejection) performed to the print medium. For the sake of clarity, the illustration of an image to be printed for the purpose of recording is omitted in FIG. 5A and FIG. 5B, but the description is given assuming that FIG. 5A and FIG. 5B show the same image. In FIG. 5A and FIG. 5B, the regions a1, b1 show the regions of the print medium on which ink droplets are applied by the in-image preliminary ejection of the on-paper preliminary ejection, while the regions a2, b2 show the regions of the print medium on which ink droplets are applied by the between-image preliminary ejection. The number of times ink is ejected by the in-image preliminary ejection is determined to be larger in the region a1 and smaller in the region b1. In each region, the ink ejection by the in-image preliminary ejection is set such that ink droplets are applied onto the region of the print medium to be spaced from each other at a certain distance. This distance is controlled by use of, for example, the conveyance speed of the print medium and a time interval between the ink ejections. In the present embodiment, as described earlier, since a minimum number of ink ejections necessary to the nozzle ejection recovery is ensured, while the on-paper preliminary ejection is performed with the lowest possible number of ink ejections, the cases in FIG. 5A and FIG. 5B are equal in the number of times ink is ejected in a series of the on-paper preliminary ejection operations in each nozzle. Specifically, the number of times ink is ejected by the preliminary ejection onto the region including the regions a1 and a2 in FIG. 5A is equal to the number of times ink is ejected by the preliminary ejection onto the region including the regions b1 and b2 in FIG. 5B. On the other hand, upon making a comparison between the region a1 and the region b1 onto which the in-image preliminary ejection is performed, the length L1 and the length L3 in the print-medium conveyance direction Y are equal each other (L1=L3) because they depend on an image to be printed for the purpose of recording.

In this connection, the number of times ink is ejected by the in-image preliminary ejection is determined to be larger in the region a1 than in the region b1 as described earlier. Specifically, the density of ink droplets applied within the image by the preliminary ejection is higher in the region a1 than in the region b1. In terms of the printed image, the brightness in the region b1 is higher than that in the region a1, and the coloring level in the region a1 is higher than that in the region b1. Next, a comparison between the region a2 and the region b2 onto which the between-image preliminary ejection is performed is made. The number of times ink is ejected is larger in the region b2 than in the region a2 as described earlier. In the between-image preliminary ejection, in terms of a reduction in the amount of paper waste, ink is set to be ejected into a shortest region in the print-medium conveyance direction Y, and the placement and density of the ink droplets in the region depend on this setting. Because of this, the region b2 into which ink is ejected repeatedly by a larger number of times has a length (L4) in the print-medium conveyance direction Y which is longer than that of the region a2 (length L2). In this manner, a larger number of times ink is ejected in the in-image preliminary ejection results in a lower brightness of the printed image which means a higher level of the so-called coloring, but a reduction in length of a region required for the between-image preliminary ejection can be achieved (see FIG. 5A). On the contrary, a smaller number of times ink is ejected in the in-image preliminary ejection results in a higher brightness of the printed image, but the length of a region required for the between-image preliminary ejection is increased (see FIG. 5B).

In the present embodiment, as described above, in order to provide a printed image of a somewhat high brightness, ink is ejected in the in-image preliminary ejection such that an interval between the applied ink droplets is equal to or longer than a certain distance in the print-medium conveyance direction Y.

Next, an ink density in the in-image preliminary ejection will be described. The ejection recovery, which is achieved through the preliminary ejection with a necessary number of times ink is ejected at given time intervals, is required for normal ejection of ink from each nozzle. On the other hand, in light of the image quality, there is an upper limit to the number of ink droplets ejected by the preliminary ejection into a unit region of the print image, that is, the ink density. For this reason, based on the information on the conveyance speed of the print medium and an ink density which can be achieved by the preliminary ejection to an image to be printed, it can be determined that the in-image preliminary ejection should be performed from which nozzle with which timing. Then, an ink density which can be provided by the preliminary ejection per unit region can be obtained/acquired by making a calculation based on the information regarding desired image quality.

Figure 6:
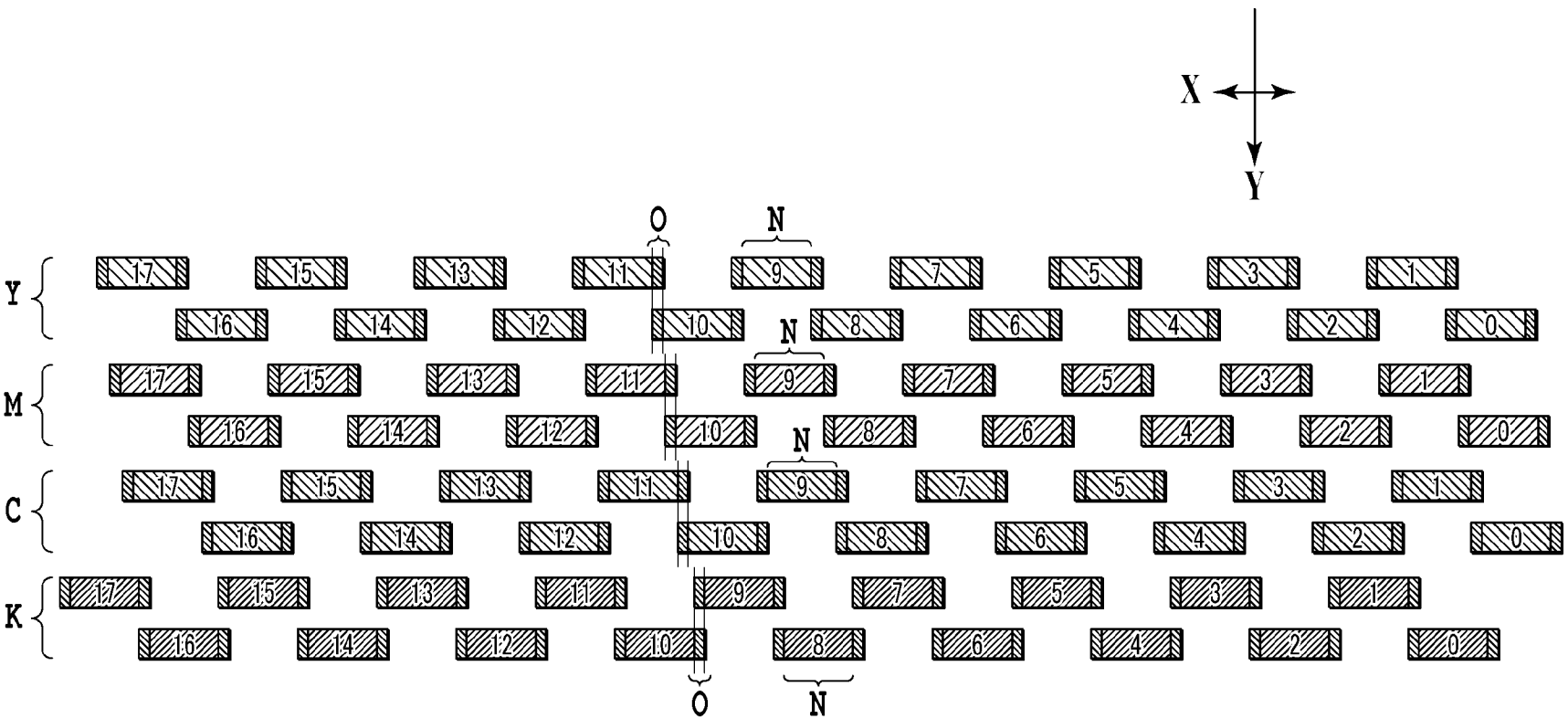
FIG. 6 is a plan view showing the arrangement of chips in the print head according to an embodiment of the present invention.

Next, a control method of performing the preliminary ejection from the print head in the present embodiment will be described with reference to FIG. 6. FIG. 6 illustrates an array of the chips 32 in detail when the print head 2 is provided for four colors of cyan (C), magenta (M), yellow (Y) and black (B). The link regions O of the chips 32 for the respective four colors are displaced from each other on a color basis.

Figure 7A:
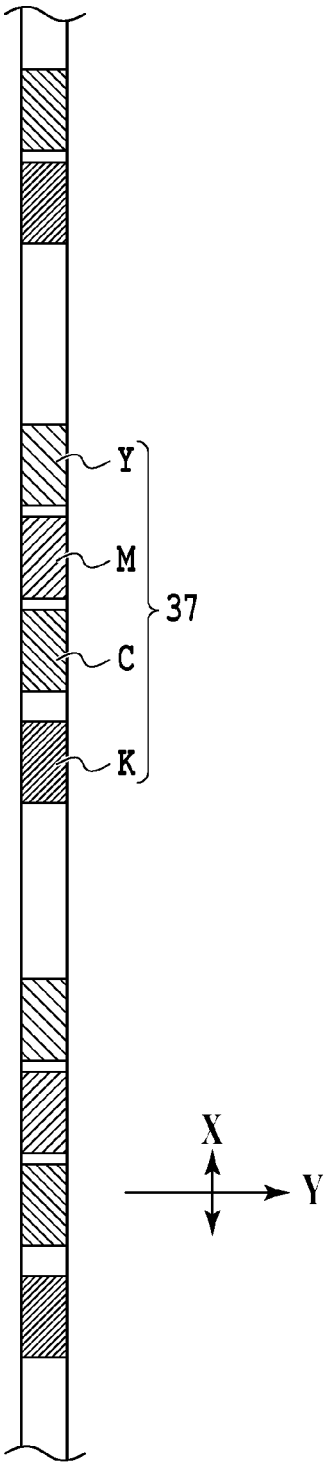
FIG. 7A is a plane view showing the pattern of between-image preliminary ejection from nozzles located in a link region in the print head according to an embodiment of the present invention.

First, when an image to be printed for the purpose of recording is printed, the in-image preliminary ejection is performed by all the nozzles located in the non-link region N and the nozzles used to print the image out of the nozzles located in the link region O. Then, the between-image preliminary ejection is performed only by all the nozzles located in the link region O. FIG. 7A is an enlarged view of a part in FIG. 5B, which shows the layout of pattern of the ink droplets applied on the print medium through the between-image preliminary ejection, when the between-image preliminary ejection is performed only by the nozzles in the link region O.

Next, returning to FIG. 3, the steps after the nozzle ejection recovery operation will be described. At step S14, the conveying motor driver 66 controls the conveying roller for conveying the print medium 3 to terminate the conveying of the print medium 3. An instruction from the CPU 62 controls the operation of the print head 2 to terminate the printing of the image. At step S15, the carriage motor driver 64 operates the mechanism motor 65 to move the print head 2 after the printing operation from the printing position to a predetermined position for performing the preliminary ejection on an area other than the print medium (preliminary ejection position). Likewise, the carriage motor driver 64 moves the cap unit up to under the print head 2 such that the print head 2 can preliminarily eject ink on the area other than the print medium. At step S16, an instruction from the CPU 62 controls the operation of the print head 2 to perform the preliminary ejection into the inside of the cap. At step S17, the motor driver 64 drives the mechanism motor 65 to move the print head from the preliminary-ejection position to the cap position and the operation is terminated.

As described above, in the ejection recovery method for the nozzle of the print head 2, the between-image preliminary ejection is controlled in accordance with the placement of the nozzle. Specifically, regarding the nozzles included in the link region, (A) the in-image preliminary ejection is performed by the nozzles used to print an image out of all the nozzles in the link region, and (B) the between-image preliminary ejection is performed by all the nozzles in the link region. The preliminary ejection for the nozzles included in the non-link region is performed in the in-image preliminary ejection operation. In consequence, it is possible to achieve the ejection recovery for solving the disadvantages such as deterioration in printing quality and the like which result from an ejection failure caused by clogging in a nozzle in the print head or the like or from an increase in ink concentration caused by evaporation of water from a nozzle, while inhibiting the coloring and the like with a minimum ink consumption and a minimal amount of paper waste.

In the above structure, the between-image preliminary ejection is performed by all the nozzles of 8 rows included in the link region. In another possible structure, the between-image preliminary ejection may not be performed by the nozzles by which the in-image preliminary ejection is performed in order to further reduce the amount of paper waste produced by the between-image preliminary ejection. In other words, the nozzles, used to print an image, out of the nozzles in the link region perform only the in-image preliminary ejection, and the nozzles not used to print the image perform the between-image preliminary ejection, thus achieving a further reduction in paper waste.

Second Embodiment

The print heads 2 employed in the first embodiment comprise the CMYK inks, but in the second embodiment the print heads comprise a light cyan (Lc) ink, a light magenta (Lm) ink and a light ink of gray (Gy) in addition to the CMYK inks. The concentration of color materials in the Lc ink is lower than that in the C ink. The concentration of color materials in the Lm ink is lower than that in the M ink. The concentration of color materials in the Gy ink is lower than that in the K ink.

If an ink containing a high concentration of the color materials is used to perform the in-image preliminary ejection into the inside of the print image, the ink printed by the preliminary ejection, that is, the ink applied independently of the purpose of recording the image, may be possibly conspicuous. To provide a print with high image quality, an ink of an easily conspicuous color may possibly not be used to perform the in-image preliminary ejection.

Accordingly, in the present embodiment, the nozzles performing the in-image preliminary ejection are limited to the nozzles ejecting the Lc, Lm and Gy inks containing a small concentration of color materials, and the nozzle ejecting the Y ink which has a high brightness and is inconspicuous, among the C, M, Y, K, Lc, Lm, Gy inks. That is, the structure described in the first embodiment, in which, among the nozzles included in the link region, (A) the in-image preliminary ejection is performed by the nozzles used to print an image, out of all the nozzles in the link region, and (B) the between-image preliminary ejection is performed by all the nozzles in the link region, is applied to the nozzle rows from which the light-colored inks are ejected. Out of the nozzles ejecting the Lc, Lm, Gy and Y inks (light-colored inks) by which the in-image preliminary ejection is performed, the nozzles located in the non-link region perform only the in-image preliminary ejection, and the nozzles located in the link region perform both the in-image preliminary ejection and the between-image preliminary ejection. Out of the nozzles located in the link region, the nozzles performing only the between-image preliminary ejection, the nozzles performing only the in-image preliminary ejection, and the nozzles performing both the in-image preliminary ejection and the between-image preliminary ejection may be determined as similar to the case of the first embodiment. The nozzles ejecting the C, M and K inks do not perform the in-image preliminary ejection but perform only the between-image preliminary ejection at all times.

Third Embodiment

In the foregoing embodiments the in-image preliminary ejection is performed by the nozzles used to print, that is, the nozzles included in the non-link region of the print head, and the nozzles used to print out of the nozzles included in the link region. The between-image preliminary ejection is performed by all the nozzles or the nozzles not used to print out of the nozzles included in the link region. However, in the third embodiment, if the number of times ink should be ejected into the inside of the print image as the in-image preliminary ejection is not completed, the between-image preliminary ejection makes up for the shortage of the preliminary ejection. This will be described below in detail.

As described earlier, the preliminary ejection requires to eject ink by a required number of times at intervals of a certain time period, but concerning the image quality, there is an upper limit to the ink density which can be provided by the preliminary ejection. For example, in a mode for printing an image at high quality, the ink density which can be provided by the preliminary ejection is reduced, and therefore the in-image preliminary ejection involving the required number of ink ejections during the printing of the image may possibly not be performed. In a mode in which a speed of conveyance is higher or a mode in which an image to be printed is small, it is difficult to perform the in-image preliminary ejection involving the required number of ink ejections.

In terms of the above description, in the present embodiment, if the number of ink ejections of the preliminary ejection required by each nozzle cannot be ensured only by performing the in-image preliminary ejection, the between-image preliminary ejection is performed in addition to the in-image preliminary ejection. In consequence, all the nozzles can be maintained in the normal ejection state, while the paper waste can be reduced and an image of high quality can be provided. Then, the ink density which can be provided by the preliminary ejection per unit region can be controlled on the basis of desired image quality.

Figure 9:
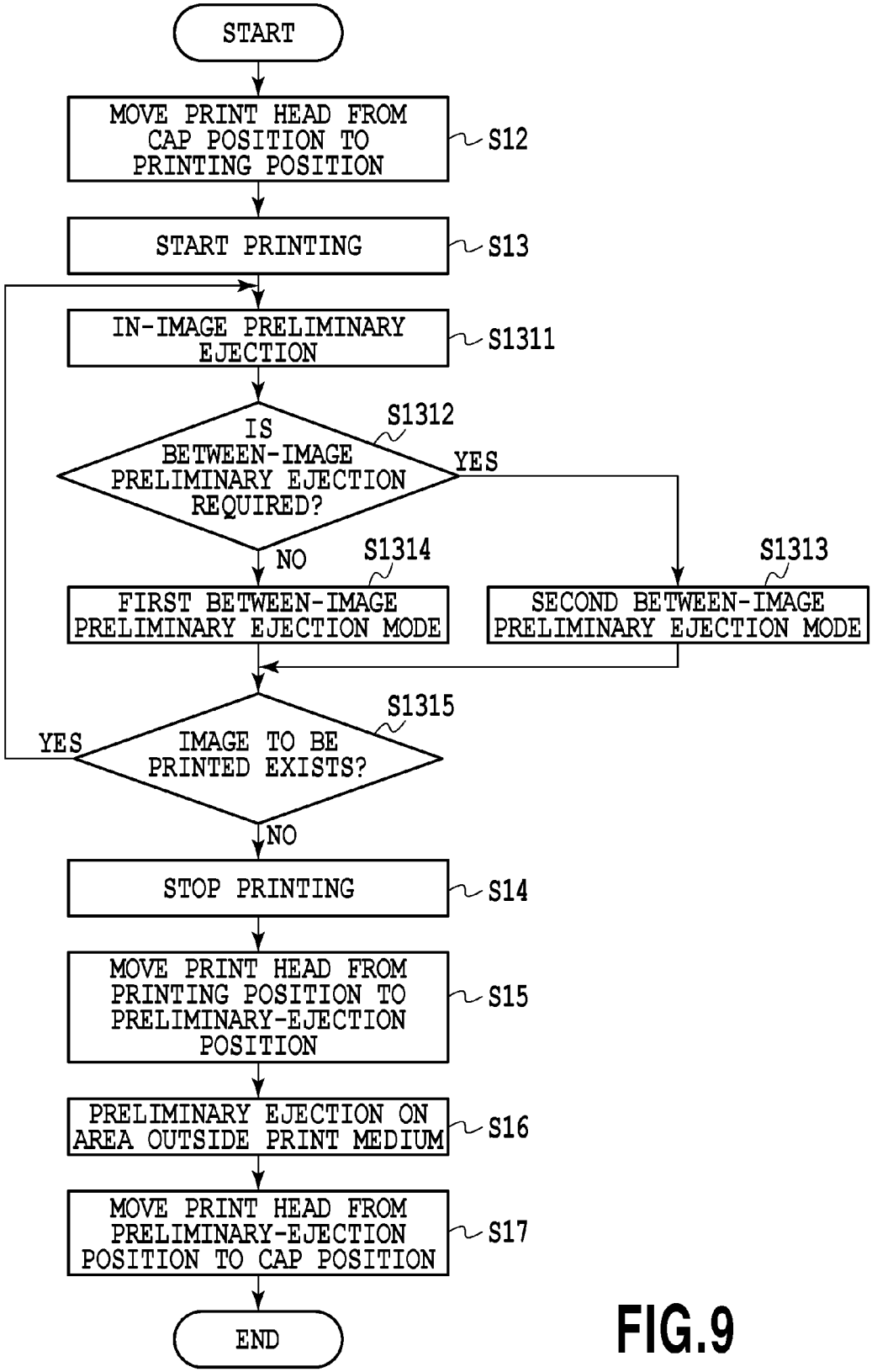
FIG. 9 is a flowchart showing a control method for on-paper preliminary ejection.

The control method for the on-paper preliminary ejection as described above is shown in from step S1311 to step S1315 in FIG. 9. First, at step S1311, the in-image preliminary ejection is performed during the printing of an image to be printed under instructions from the user. At step S1312, the control unit determines whether the required number of ink ejections of the preliminary ejection is completed during the printing of the image or the between-image preliminary ejection is required. At this stage, the target nozzles under the determination are the nozzles performing the in-image preliminary ejection, that is, all the nozzles included in the non-link region N, and the nozzles used to print the image in the link region. The control unit obtains, for example, the number of ink ejections of the preliminary ejection required per unit time, and then determines, based on the obtained number of ink ejections and the ink density, whether or not the required preliminary ejection is performed during the printing of the image by each of the nozzles performing the in-image preliminary ejection. When it is determined that the between-image preliminary ejection is not necessary, at step S1314, the control unit activates the first between-image preliminary ejection mode. That is, the between-image preliminary ejection is performed only by the nozzles that are not used to print in the link region. On the other hand, when it is determined that the between-image preliminary ejection is necessary, at step S1313, the control unit activates the second between-image preliminary ejection mode. That is, not only the nozzles that are not used to print in the link region, but also the nozzles that cannot perform the required preliminary ejection during the printing perform the between-image preliminary ejection. Then, at step S1315, the control unit determines whether or not the subsequent image to be printed exists. When it exists, the procedure goes back to step S1311, and when it does not exist, the procedure goes to step S1315.

Figure 7B:
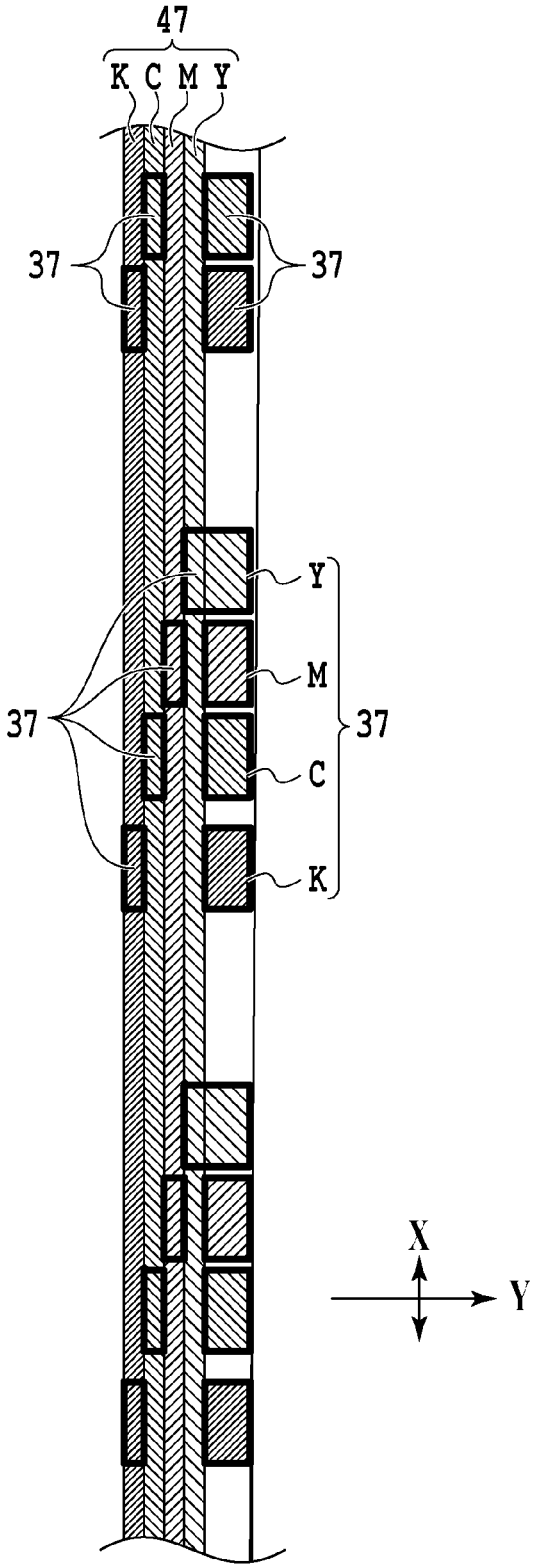
FIG. 7B is a plane view showing the pattern of between-image preliminary ejection from nozzles located in the link region and a non-link region in the print head according to an embodiment of the present invention.

FIG. 7B illustrates the layout of the pattern of the ink droplets applied onto the print medium by the between-image preliminary ejection when the between-image preliminary ejection is performed on both the link region O and the non-link region N. In FIG. 7A and FIG. 7B, reference signs Y, M, C and K denote ink colors. In FIG. 7B, reference sign 37 denotes the layout of the pattern of the ink droplets applied onto the print medium by the between-image preliminary ejection in relation to the nozzles in the link region O, and likewise reference sign 47 does so in relation to the nozzles in the non-link region N. As is seen from the drawings, when the between-image preliminary ejection is performed by the nozzles in the non-link region N, it is performed simultaneously by the nozzles in the link region O. Thus, a reduction in the amount of print media used for the on-paper preliminary ejection, as well as a reduction in the amount of paper waste, can be achieved.

Other Embodiments

The foregoing embodiments employ the print head having the chip array such that one nozzle row is in the non-link region, while two nozzle rows are in the link region, but the number of overlapping nozzle rows or of chips is not limited to this, to which the present invention can be applied.

The ink density which can be provided by the preliminary ejection to unit region of the print medium is varied depending on a type of the print medium and a type of the ink. Accordingly, the ink density may be determined in accordance with a type of a print medium. The ink density may be determined in accordance with a type of ink, quality of the print image or mode.

The foregoing embodiments use the gradation mask to determine which nozzle of the nozzles included in the link region is used to print, that is, which nozzle the image data are distributed to, but the present invention is not limited to this. The feature of the present invention is that the preliminary ejection from the nozzles used to print out of the nozzles in the link region is performed in the in-image preliminary ejection operation, and the preliminary ejection from the nozzles not used to print is performed in the between-image preliminary ejection operation. That is, how to determine the nozzles used to print is not limited to the foregoing method, and any method can be employed. In the foregoing embodiments, in the non-link region all the nozzles perform the in-image preliminary ejection, but, for example, for printing an image at high quality, the in-image preliminary ejection may not be performed in response to request of the user and the between-image preliminary ejection alone may be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-028917, filed Feb. 14, 2011, which is hereby incorporated by reference herein in its entirety.

What is claimed is:

1. An inkjet printing device comprising:

a print head that includes a first nozzle row in which a plurality of nozzles are arranged along a predetermined direction, and a second nozzle row in which a plurality of nozzles are arranged along the predetermined direction, the first nozzle row and the second nozzle row being displaced with respect to each other in a conveyance direction crossing the predetermined direction and a part of the first nozzle row and a part of the second nozzle row overlapping each other in the predetermined direction to form a link region; and a preliminary ejection unit that performs preliminary ejection of ink from each of the plurality of nozzles onto the print medium, wherein the preliminary ejection unit is capable of performing in-image preliminary ejection into the inside of an image and between-image preliminary ejection into a region between a plurality of images, and wherein the preliminary ejection unit uses a part of the nozzles included in the link region to perform the in-image preliminary ejection, and uses the nozzle not used to perform the in-image preliminary ejection out of the nozzles included in the link region to perform the between-image preliminary ejection.

2. The inkjet printing device according to claim 1, wherein the preliminary ejection unit uses all the nozzles not used to perform the in-image preliminary ejection out of the nozzles included in the link region to perform the between-image preliminary ejection.

3. The inkjet printing device according to claim 1, wherein the nozzle, which is a part of the nozzles included in the link region, is the nozzle used to print the image.

4. The inkjet printing device according to claim 1, wherein the preliminary ejection unit uses the nozzle not included in the link region to perform the in-image preliminary ejection.

5. The inkjet printing device according to claim 1, wherein the print head is capable of ejecting a plurality of colors of ink.

6. The inkjet printing device according to claim 1, wherein each of the first nozzle row and the second nozzle row is a nozzle row from which the ink of one of light-cyan, light-magenta, gray and yellow colors is ejected.

7. The inkjet printing device according to claim 1, further comprising an acquisition unit that, when the in-image preliminary ejection is performed, acquires an ink density provided by the preliminary ejection into a unit region of the print medium, based on information on a conveyance speed at which the print medium is conveyed, and information on image quality of the image to be printed.

8. The inkjet printing device according to claim 7, wherein the acquisition unit further acquires the number of times ink is ejected in the preliminary ejection required per unit time, wherein the inkjet printing device further comprises a determination unit that determines on the basis of the ink density acquired by the acquisition unit and the number of times ink is ejected in the preliminary ejection required per unit time, whether or not required preliminary ejection is performed during printing of the image in each nozzle used to perform the in-image preliminary ejection, wherein when there is a nozzle for which it is determined by the determination unit that the required preliminary ejection is not performed, the nozzle is used to perform the between-image preliminary ejection.

9. The inkjet printing device according to claim 1, further comprising a second preliminary ejection unit that operates the print head to eject ink on an area other than the print medium.

10. An inkjet printing method used by an inkjet printing device using a print head which includes a first nozzle row in which a plurality of nozzles are arranged along a predetermined direction, and a second nozzle row in which a plurality of nozzles are arranged along the predetermined direction, the first nozzle row and the second nozzle row being displaced with respect to each other in a conveyance direction crossing the predetermined direction and a part of the first nozzle row and a part of the second nozzle row overlapping each other in the predetermined direction to form a link region, comprising:

a preliminary ejection step of performing preliminary ejection of ink from each of the plurality of nozzles onto the print medium, wherein the preliminary ejection step is capable of performing in-image preliminary ejection into the inside of an image and between-image preliminary ejection into a region between a plurality of the images, and wherein the preliminary ejection step uses a part of the nozzles included in the link region to perform the in-image preliminary ejection, and uses the nozzle not used to perform the in-image preliminary ejection out of the nozzles included in the link region to perform the between-image preliminary ejection.

11. An inkjet printing apparatus comprising:

a conveying mechanism configured to convey a sheet in a first direction;

a printing head configured to perform printing by discharging ink onto the sheet, the printing head including a first nozzle chip group in which a plurality of first nozzle chips, in each of which a plurality of nozzles is arranged in a second direction crossing the first direction, is provided in the second direction and a second nozzle chip group in which a plurality of second nozzle chips, in each of which a plurality of nozzles is arranged in the second direction, is provided in the second direction, wherein the first nozzle chip group and the second nozzle chip group are arranged so as to be shifted from each other in the first direction and the first nozzle chip and the second nozzle chip adjacent to each other are shifted from each other in the second direction;

a determination unit configured to determine nozzles, among nozzles included in the first nozzle chip group and overlapping with nozzles included in the second nozzle chip group in the second direction and nozzles included in the second nozzle chip group and overlapping with nozzles included in the first nozzle chip group in the second direction, that perform preliminary ejection, in accordance with which one of a first mode for performing preliminary ejection in an image printed on the sheet or a second mode for performing preliminary ejection between images printed on the sheet is to be performed; and a preliminary ejection unit configured to make nozzles which are included in the first nozzle chip group and do not overlap with nozzles included in the second nozzle chip group in the second direction, and nozzles which are included in the second nozzle chip group and do not overlap with nozzles included in the first nozzle chip group in the second direction perform preliminary ejection in accordance with the first mode, and make nozzles which are included in the first nozzle chip group and overlap with nozzles included in the second nozzle chip group in the second direction, and nozzles which are included in the second nozzle chip group and overlap with nozzles included in the first nozzle chip group in the second direction perform preliminary ejection in accordance with the nozzles determined by the determination unit and the one of the first mode and the second mode to be performed.

12. The inkjet printing apparatus according to claim 11, wherein the determination unit determines that nozzles which are included in the first nozzle chip group, overlap with nozzles included in the second nozzle chip group in the second direction, and are used for printing an image, and nozzles which are included in the second nozzle chip group, overlap with nozzles in the first nozzle chip group in the second direction, and are used for printing an image, perform preliminary ejection in accordance with the first mode.

13. The inkjet printing apparatus according to claim 12, wherein the preliminary ejection unit makes all the determination unit determines that nozzles which are included in the first nozzle chip group, overlap with nozzles included in the second nozzle chip group in the second direction, and are not used for printing an image, and nozzles which are included in the second nozzle chip group, overlap with nozzles included in the first nozzle chip group in the second direction, and are not used for printing an image, perform preliminary ejection in accordance with the second mode.

14. The inkjet printing apparatus according to claim 11, wherein the determination unit determines that all the nozzles which are included in the first nozzle chip group and overlap with nozzles included in the second nozzle chip group in the second direction, and all the nozzles which are included in the second nozzle chip group and overlap with nozzles included in the first nozzle chip group in the second direction, perform preliminary ejection in accordance with the second mode.

15. An inkjet printing apparatus comprising:

a conveying mechanism configured to convey a sheet in a first direction;

a printing head configured to perform printing by discharging ink onto the sheet, the printing head including a first nozzle chip group in which a plurality of first nozzle chips, in each of which a plurality of nozzles is arranged in a second direction crossing the first direction, is provided in the second direction and a second nozzle chip group in which a plurality of second nozzle chips, in each of which a plurality of nozzles is arranged in the second direction, is provided in the second direction, wherein the first nozzle chip group and the second nozzle chip group are arranged so as to be shifted from each other in the first direction and the first nozzle chip and the second nozzle chip adjacent to each other are shifted from each other in the second direction;

a determination unit configured to determine nozzles which are included in the first nozzle chip group and overlap with nozzles included in the second nozzle chip group in the second direction and nozzles which are included in the second nozzle chip group and overlap with nozzles included in the first nozzle chip group in the second direction to perform preliminary ejection in accordance with a first mode for performing preliminary ejection in an image printed on the sheet or a second mode for performing preliminary ejection between images printed on the sheet;

a preliminary ejection unit configured to cause nozzles which are included in the first nozzle chip group and do not overlap with nozzles included in the second nozzle chip group in the second direction and nozzles which are included in the second nozzle chip group and do not overlap with nozzles included in the first nozzle chip group in the second direction to perform preliminary ejection in accordance with the first mode, and cause nozzles which are included in the first nozzle chip group and overlap with nozzles included in the second nozzle chip group in the second direction and nozzles which are included in the second nozzle chip group and overlap with nozzles included in the first nozzle chip group in the second direction to perform preliminary ejection in accordance with the mode determined by the determination unit.

16. The inkjet printing apparatus according to claim 15, wherein the determination unit determines nozzles which are included in the first nozzle chip group and overlap with nozzles included in the second nozzle chip group in the second direction and are used for printing an image to perform preliminary ejection in accordance with the first mode, and the determination unit determines nozzles which are included in the second nozzle chip group and overlap with nozzles included in the first nozzle chip group in the second direction and are used for printing an image to perform preliminary ejection in accordance with the first mode.

17. The inkjet printing apparatus according to claim 16, wherein the determination unit determines nozzles which are included in the first nozzle chip group and overlap with nozzles included in the second nozzle chip group in the second direction and are not used for printing an image to perform preliminary ejection in accordance with the second mode, and the determination unit determines nozzles which are included in the second nozzle chip group and overlap with nozzles included in the first nozzle chip group in the second direction and are not used for printing an image to perform preliminary ejection in accordance with the second mode.

* * * * *